US012605754B2

(12) United States Patent
Bucci et al.

(10) Patent No.: US 12,605,754 B2
(45) Date of Patent: Apr. 21, 2026

(54) REDUCER AND/OR CALIBRATING ROLLING MILL FOR ROD-SHAPED BODIES

(71) Applicant: DANIELI & C. OFFICINE MECCANICHE S.P.A., Buttrio (IT)

(72) Inventors: Annibale Bucci, Dalmine (IT); Danilo Galletti, Milan (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 173 days.

(21) Appl. No.: 18/254,136

(22) PCT Filed: Nov. 25, 2021

(86) PCT No.: PCT/IB2021/060961
§ 371 (c)(1),
(2) Date: May 23, 2023

(87) PCT Pub. No.: WO2022/112986
PCT Pub. Date: Jun. 2, 2022

(65) Prior Publication Data

US 2024/0001419 A1 Jan. 4, 2024

(30) Foreign Application Priority Data

Nov. 27, 2020 (IT) ..... 102020000028772

(51) Int. Cl.
*B21B 35/02* (2006.01)
*B21B 1/18* (2006.01)
(Continued)

(52) U.S. Cl.
CPC ..... *B21B 35/025* (2013.01); *B21B 1/18* (2013.01); *B21B 13/005* (2013.01);
(Continued)

(58) Field of Classification Search
CPC ..... B21B 35/025; B21B 1/18; B21B 13/005; B21B 13/103; B21B 17/14; B21B 2271/02
See application file for complete search history.

(56) References Cited

U.S. PATENT DOCUMENTS 4,366,694 A * 1/1983 Pariseau ..... B21B 13/12 72/235
5,765,423 A * 6/1998 Cattaneo ..... B21B 17/14 72/224
(Continued)

FOREIGN PATENT DOCUMENTS

EP 0719600 A1 7/1996
WO 9947284 A1 9/1999
(Continued)

OTHER PUBLICATIONS

Patent Cooperation Treaty, International Search Report and Written Opinion for International Application No. PCT/IB2021/060961, Feb. 23, 2022, 13 pages.

*Primary Examiner* — Mohammed S. Alawadi
(74) *Attorney, Agent, or Firm* — Stetina Garred Brucker & Newboles

(57) ABSTRACT

A stretch reducer and/or calibrating rolling mill for rod-shaped bodies, in particular tubular bodies, in particular hollow bodies, said rolling mill comprising a plurality of rolling stands each comprising a plurality of rolling rollers mutually arranged so as to define a passage for said rod-shaped bodies, wherein said rolling stands are arranged in sequence along a rolling direction so that the respective passages are substantially aligned to define a rolling path substantially parallel to said rolling direction, wherein each of at least two of said rolling stands comprises three rolling rollers.

14 Claims, 7 Drawing Sheets

(51) Int. Cl.
*B21B 13/00* (2006.01)
*B21B 13/10* (2006.01)
*B21B 17/14* (2006.01)

(52) U.S. Cl.
CPC ..... *B21B 13/103* (2013.01); *B21B 17/14* (2013.01); *B21B 2271/02* (2013.01)

(56) References Cited

U.S. PATENT DOCUMENTS

| | | | | |
|---|---|---|---|---|
| 6,041,635 | A * | 3/2000 | Cattaneo | B21B 25/02 72/235 |
| 2008/0196236 | A1* | 8/2008 | Giuseppe | B21B 1/08 72/203 |
| 2018/0304327 | A1* | 10/2018 | Cernuschi | B21B 17/14 |

FOREIGN PATENT DOCUMENTS

| | | | |
|---|---|---|---|
| WO | 2009141414 | A1 | 11/2009 |
| WO | 2017068533 | A1 | 4/2017 |

* cited by examiner

REDUCER AND/OR CALIBRATING ROLLING MILL FOR ROD-SHAPED BODIES

CROSS-REFERENCE TO RELATED APPLICATIONS

This application claims priority to PCT International Application No. PCT/IB2021/060961 filed on Nov. 25, 2021, which applications claims priority to Italian Patent Application No. 102020000028772 filed on Nov. 27, 2020, the entire disclosures of which are expressly incorporated herein by reference.

STATEMENT RE: FEDERALLY SPONSORED RESEARCH/DEVELOPMENT

Not Applicable

BACKGROUND

Field of the Invention

The present invention belongs to the technical field of iron and steel industry. In particular, the present invention belongs to the technical field of the production, by rolling, of rod-shaped products, such as rods, bars or similar products, but also of hollow tubular products, and therefore, in particular, of pipes. In detail, the present invention relates to a rolling mill for producing, by rolling, products of the aforesaid type. Even more in detail, the present invention relates to a reducer and/or calibrating rolling mill for producing, by gradual reduction and/or calibration, rod-shaped products, in particular tubular products, in particular hollow products.

Background Art

The plants of the known type for producing seamless pipes by hot rolling employ various types of machines and technologies which have been developed in successive steps over the years and which have different features, both in terms of applicability and performances, depending on the product to be manufactured, as well as in terms of investment and operating or management costs. Some technologies have been progressively replaced over the years by more innovative ones, in particular, starting with the invention of the retained mandrel rolling mill (MPM—Multistand Pipe Mill), both in new plants but also for the revamping of existing plants. Despite this, at present, the landscape of the plants in operation existing worldwide still sees the employment of almost all of these technologies, depending on the geographical and application contexts. For example, even technologies that have existed for over a century, such as the Pilger Mill, the Plug Mill, the Diesher Mill (AccuRoll) and the Assel Mill, are still operating.

This number of technological alternatives is generally known to those skilled in the art, and an exemplary process flow which may be considered representative of the process configuration is based on the 3 main steps of plastic deformation (rolling), such process flow comprising billet heating, followed by billet piercing (main step 1), followed by shell elongation over a mandrel or plug (main step 2), followed by intermediate heating, and finally followed by mother pipe sizing or stretch and sizing (main step 3).

With reference to the above scheme, it is apparent that the last main rolling step (3), whether or not it is preceded by an intermediate heating, always consists of a step of calibrating (reducing—sizing) the external diameter of the pipe. The calibration may be possibly coupled, depending on the configurations, to a stretching/compression action of the pipe itself, exerted by virtue of a difference in the rotation speed of the motorized rollers present in stands arranged in sequence along the rolling direction, so as to also generate variations in the thickness of the pipe itself in addition to those which are generated as a result of the calibration itself. In most cases, the calibration is carried out through a longitudinal multi-stand rolling process (with a movement of the pipe in the direction of the axis thereof), wherein some plants use calibration machines with rollers with non-intersecting axes positioned so as to give the pipe a rototranslational movement, thus reducing the diameter thereof by adjusting the gap between the rollers themselves (Rotary sizer); these machines, being of the single-stand type, are not capable of generating a pulling/compression effect in the pipe.

The machines which carry out the calibration process are therefore divided into two macro types: Sizing Mill and Stretch Reducing Mill, depending on whether or not they are able to also impart a stretching action on the pipe. Limited to longitudinal multi-stand machines, a considerable number of stands is usually required to generate a consistent stretching/compression action, wherein sizing mills usually comprise from 7 to 14 stands while Stretch Reducing Mills comprise from 16 to 32 stands. Therefore, such machines generally consist of a sequence of rolling stands, each provided with rollers in a variable number between two (usually, only for Sizing mill), three or four rollers, which in turn are motorized (all or some thereof), the rollers being mutually positioned so as to define forced passages for the tubular product of a decreasing diameter, and being profiled in a manner appropriate according to the process conditions given to obtain the required dimensional quality.

For reasons of synthesis and clarity of presentation, reference will be made below to calibration machines with a configuration with 3 rollers per stand. In turn, this type of machines is usually divided from the mechanical point of view into two large families which differ as to how the speed is transferred from the motors to the 3 rollers and therefore, in particular, as to the configuration of the rolling stands, said two large families of machines thus comprising internal gear stand machines and machines with individual drive shafts. The latter are in turn usually divided according to the presence of a single motor for the 3 rollers of each stand—external gears—or a motor for each roller.

It should also be considered that all the machines pertaining to the category of longitudinal sizing mills and/or stretch reducing mills installed in the world belong to one of the above categories and have the rollers positioned in the Y/A configuration, i.e., with one of the rollers having an axis of horizontal rotation and the other two with rotation axes inclined by +600 or −60° with respect to the horizontal axis passing through the rolling center. Furthermore, in the machines of the aforesaid type, each pair of subsequent and adjacent stands comprises a stand known as of the "even" type and a stand known as of the "odd" type, wherein the arrangement of the rollers of the odd stand corresponds to that of the even stand when subjected to a 180° rotation about the horizontal axis passing through the rolling center. Such a shape mostly originates from the rolling mill with internal gear stands, in which case, such a configuration allows the torque transmission joint to be engaged by utilizing the movement itself of inserting the stand into the rolling mill, in case this occurs through the translation of the stand in the direction parallel to the axis of the horizontal roller. In the case of the machine with individual drive stands, such a shape has been preserved, however resulting in plant and maintenance disadvantages.

The rolling machines or rolling mills according to the prior art described above have various disadvantages and/or drawbacks which the Applicant intends to overcome or at least minimize by means of the present invention.

A first drawback relates to the fact that the symmetry about the horizontal axis requires, for each stand, two abutments for the vertical positioning of the stand, each of said two abutments being used according to the positioning of the stand as a stand of the even type or that of the odd type, wherein, therefore, even if roller regeneration systems with stand turning are used, this must be overturned between the preparation condition and the working condition.

A second drawback or disadvantage relates to the significant effects of gravity, which causes the wear of different parts of the stand depending on whether it is an even stand or an odd stand.

A further disadvantage relates to the scarce safety and practicality/speed in the management/preparation of the equipment, since the rotation about the horizontal axis requires special equipment with risk of accidents, such as, for example, for the 180° rotation about the horizontal axis, typical of the Y/A configuration.

A further disadvantage or drawback relates to the difficulty, if not the impossibility, of implementing an individual locking system for each stand in the 3 directions, in particular due to mechanical constraints which up to now have not been overcome.

It is also part of the drawbacks affecting machines or equipment, in particular rolling mills of the known type, the fact that said machines or equipment require a positioning of the motors, reducers and/or transmission systems (in the case of a configuration with individual drive for each roller), too close to the stands—in the underlying position—with obvious problems of damage due to water and scale and high maintenance costs and consequent downtime due to difficult accessibility.

Furthermore, there are not completely negligible problems of vibration/oscillation/impact of the stands with respect to the frame of the machine, triggered by the "alternative" feature of the process that at each rolling cycle there is a loading transient, an unloading transient, a continuous loading stage, a waiting stage, with related excessive noise of the machine, wear and deterioration of the alignment surfaces of the stands, high maintenance costs, and reduced reliability of the machine and production process.

Furthermore, machines or equipment of the known type do not allow a correct and constant alignment of the rolling stands in all directions, with apparent negative impacts on the quality of the product and on safety due to the risks of missed feed and/or leakage of the product and/or sticking.

Furthermore, machines or equipment of the known type, if they overcome the issue of stand locking through an axial compression (along the rolling direction), require excessive times for changing the product, since the stands may not be unlocked and/or replaced individually and the filling of the entire rolling train with transport stands is constantly required even where rolling would require a limited amount thereof.

The solutions according to the prior art use for the alignment of the stands, in at least one direction, the same surfaces used for the insertion/extraction movement thereof, said guides being therefore subject to sliding even when the contact is contaminated by abrasive agents such as rolling scale. Furthermore, since the machines according to the prior art have a Y/A symmetry, the alignment surfaces change between the upper or lower ones of the stand depending on whether the latter is mounted in an even or odd position in the machine.

Finally, the most commonly known solutions provide that the positioning of the stands in the machine occurs through a lateral translation, by means of a thrust crossbeam. Due to the nature of such a system (common beam for all the stands or for groups of stands), it is not possible to ensure the correct simultaneous stop of all stands against the mechanical abutments in the machine, thus compromising the correct alignment. In particular, some variants of these machines are completely devoid of a stand locking system in the lateral direction, wherein locking is carried out by utilizing the friction generated by locking in the axial direction. On the other hand, other variants carry out the locking through an upper cylinder inclined by about 45°, which therefore pushes the stand downwards and in the direction of entry thereof into the machine. However, such a shape does not ensure the correct recovery of the possible gap with respect to the lateral mechanical stops due to the resistance induced by the friction on the guides in the area underlying the stand amplified by the vertical force component generated by the aforesaid cylinder.

Further examples of stretch reducer and/or calibrating rolling mills for rod-shaped bodies, in particular tubular bodies, in particular hollow bodies, according to the prior art, are known from document WO 2017/068533.

OBJECTS OF THE PRESENT INVENTION

Therefore, it is the main object of the present invention to provide a rolling apparatus or machine, in particular a stretch reducer and/or calibrating rolling mill for rod-shaped bodies, in particular tubular bodies, in particular hollow bodies, which allows overcoming or at least reducing the disadvantages and/or drawbacks affecting plastic deformation apparatuses or stations according to the prior art.

In detail, the primary objects of the present invention may be summarized as follows.

Ensuring the vertical alignment and abutment of each stand, independently thereon whether the stand is used in an even or an odd position and therefore so that, even if roller regeneration systems with stand turning are used, the need never arises to be overturned between the preparation condition and the working condition;

eliminating or at least reducing the effects of gravity;

ensuring greater safety and practicality/speed in the management/preparation of the equipment with respect to machines which need to rotate the stands 1800 about the horizontal axis;

offering the possibility of implementing an individual locking and alignment system for each stand in the 3 directions;

permitting a positioning of the motors (in the case of a configuration with individual drive for each roller), reducers and transmission systems which is advantageous with respect to existing machines since it is more distant from the vertical passing through the rolling axis and therefore far from water and scale which are typically the cause of damage and high maintenance costs;

permitting the individual locking of the stands, thus avoiding issues relating to the vibration/oscillation/impact of the stands with respect to the frame of the machine, triggered by the "alternative" feature of the process, for which at each rolling cycle there is a loading transient, an unloading transient, a continuous loading stage, a waiting stage, and, where it is possible, within the cycle itself, having rolling loads, in particular torques necessary for the rollers, which change direction from positive to negative and vice versa;

reducing the noise of the machine, limiting the wear thereof and the deterioration of the alignment surfaces of the stands, thus reducing maintenance costs, and improving the reliability of the machine and production process;

ensuring a correct and constant alignment of the rolling stands in all directions, with a consequent advantage on the quality of the product and on safety, taking into consideration the limitation of the risks of missed feed and/or leakage of the product and/or sticking;

reducing product changing times, allowing to individually replace the stands and consequently also to move the minimum possible number of stands;

reducing operating costs, limiting the number of guide stands with a consequent reduction in weight and/or complexity of the equipment;

avoiding cumulative displacements between the stands, linked to processing tolerances and/or wear in the application of the locking in the axial direction (along the rolling axis).

It is a further object of the present invention to provide a rolling mill of the aforesaid type adapted to reduce the wear of the alignment guides by utilizing, for the vertical and longitudinal alignment from the lower side of the stand, the central part thereof, which is therefore protected from water and scale during the rolling, and by leaving the space between two adjacent stands completely open below for the outflow of water and scale.

Finally, it is a further object of the present invention to provide a rolling mill which ensures the correct alignment of the stands and the locking thereof in the alignment position.

DESCRIPTION OF THE PRESENT INVENTION

Therefore, in view of both the preset objects summarized above and the drawbacks and/or disadvantages affecting the rolling mills of the prior art, the present invention relates to a rolling mill according to the main claim 1, wherein further embodiments of the rolling mill according to the present invention are defined by the dependent claims.

According to an embodiment described, a stretch reducer and/or calibrating rolling mill for rod-shaped bodies, in particular tubular bodies, in particular hollow bodies, comprises a plurality of rolling stands each comprising a plurality of rolling rollers mutually arranged so as to define a passage for said rod-shaped bodies, wherein said rolling stands are arranged in sequence along a rolling direction so that the respective passages are substantially aligned to define a rolling path substantially parallel to said rolling direction, wherein each of at least two of said rolling stands comprises three rolling rollers, wherein in each of said at least two rolling stands, the rotation axis of at least one roller is oriented vertically.

According to an embodiment described, in each of said at least two rolling stands, the vertical rotation axis of said at least one rolling roller does not coincide with a vertical axis passing through the center of said passage.

According to an embodiment described, said at least two rolling stands are arranged adjacent to each other along said rolling direction, wherein the position of the rolling rollers of a first rolling stand of said at least two rolling stands corresponds to the position of the rollers of the second rolling stand of said at least two rolling stands resulting from the 180° rotation of said second rolling stand about a vertical rotation axis passing through the center of said passage.

According to an embodiment described, in each of said at least two rolling stands, the rolling rollers, other than said at least one roller with a vertical rotation axis, have rotation axes arranged to form 210° and 330° angles, respectively, with respect to a horizontal reference perpendicular to the vertical axis passing through the center of said passage.

According to an embodiment described, each of said at least two rolling stands is individually constrained within said rolling mill.

According to an embodiment described, each of said at least two rolling stands is translationally positionable between a first position, in which the respective passages are substantially aligned to define said path, and a second position, wherein in said first position, each of said at least two rolling stands rests on a respective positioning guide shaped so that the translation from said second position to said first position on said positioning guide results in the at least vertical positioning of said rolling stand.

According to an embodiment described, said respective positioning guide of each of said at least two rolling stands is shaped so that the translation of said rolling stand on said positioning guide results in the positioning even along a direction parallel to the rolling direction of said rolling mill.

According to an embodiment described, said respective positioning guide of each of said at least two rolling stands extends parallel to the translation direction of said rolling stand between said first position and second position, wherein the cross-section of each of said respective positioning guides is trapezoidal.

According to an embodiment described, for each of said at least two rolling stands, the portions of said respective positioning guide in contact with the rolling stand correspond to portions of the inclined surfaces of said positioning guide.

According to an embodiment described, for each of said at least two rolling stands, said rolling mill comprises a translation guide, wherein the translation of each of said at least two rolling stands between said first position and second position partly occurs on said positioning guide and partly on said translation guide. According to an embodiment described, each of said translation guides has a transversal shape which is different from that of the respective positioning guide.

According to an embodiment described, for each of said at least two rolling stands, said rolling mill comprises a transversal positioning abutment for positioning said rolling stand transversely to said rolling direction and parallel to said translation direction.

According to an embodiment described, for each of said at least two rolling stands, the translation from said second position to said first position results in the mutual engagement of said positioning abutment and said rolling stand.

According to an embodiment described, each of said positioning abutments comprises first repositioning means adapted to act upon thrust against said rolling stand in the translation direction of said stand from said second position to said first position.

According to a further embodiment described, each of said positioning abutments comprises second alternative repositioning means adapted to act upon traction on said rolling stand in the translation direction of said stand from said second position to said first position.

According to an embodiment described, said second positioning means comprise a piston which is translatable in two opposite translation directions along a direction parallel to the translation direction of said stand between said first position and second position, where said rolling stand comprises a seat adapted to be engaged by said piston.

According to an embodiment described, said piston may be rotated about the longitudinal axis of symmetry thereof, wherein said seat of said rolling stand is shaped so as to accommodate the free end of said piston, wherein the rotation of said piston, from a first position thereof to a second position thereof, results in the mutual constraint of said rolling stand and said piston, so that the retraction of said piston results in a traction exerted on said rolling stand.

DETAILED DESCRIPTION OF THE DRAWINGS

A description of the embodiments of the present invention as depicted in the drawings is provided below, wherein.

It must be considered that the present invention is not limited to the embodiments described hereafter and depicted in the accompanying drawings; on the contrary, all the variants and/or changes to the embodiments described below and depicted in the accompanying drawings which will appear obvious and immediate to a person skilled in the art fall within the scope of the present invention.

DETAILED DESCRIPTION OF THE PRESENT INVENTION

The present invention finds particularly advantageous application to the production of hollow tubular products, and therefore substantially of pipes, this being the reason why the present invention will be described below with particular reference to the applications thereof in the field of the production of hollow pipes with a circular cross section.

However, it is worth specifying that the possible applications of the present invention are not limited to those described below. On the contrary, the present invention can be conveniently applied to all cases in which the need arises of optimizing the performance of a rolling mill for the production of products, such as for example bars and/or rods, regardless of the shape and type of the products produced by means of said rolling mill.

Figure 1:
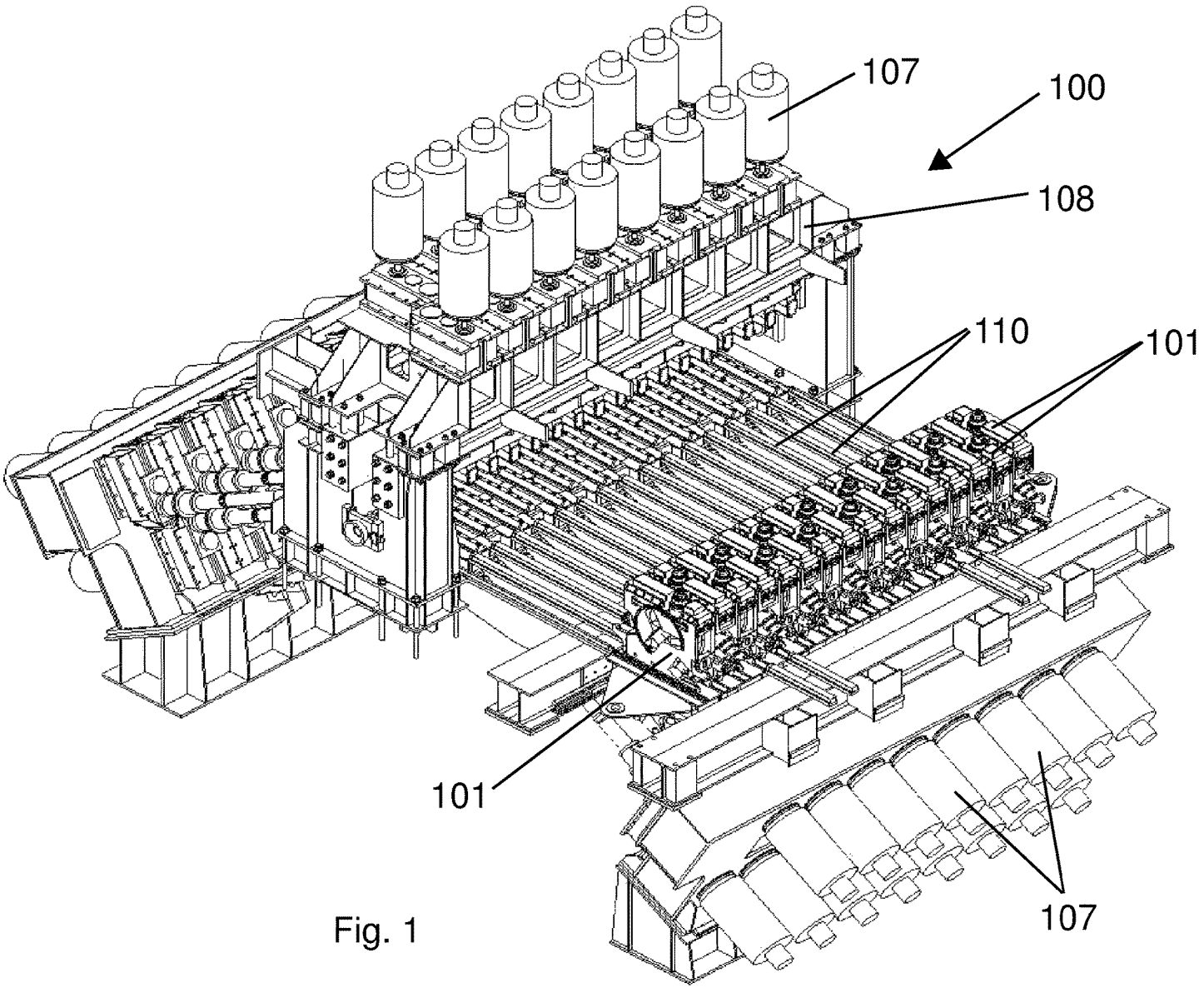
FIG. 1 shows a perspective view of a rolling mill according to an embodiment.
Figure 2:
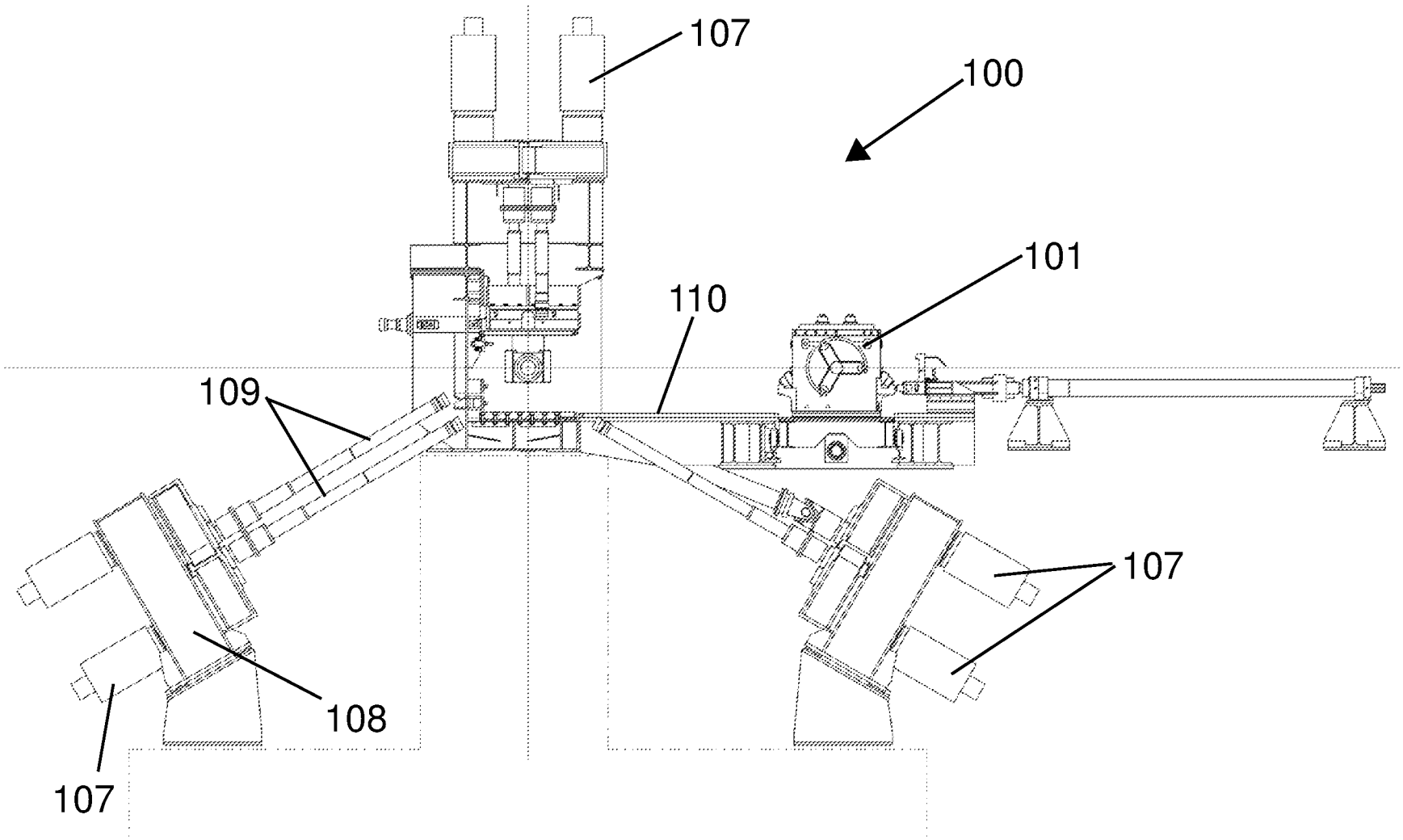
FIG. 2 shows a front view of a rolling mill according to an embodiment with at least one stand in the resting position.
Figure 3:
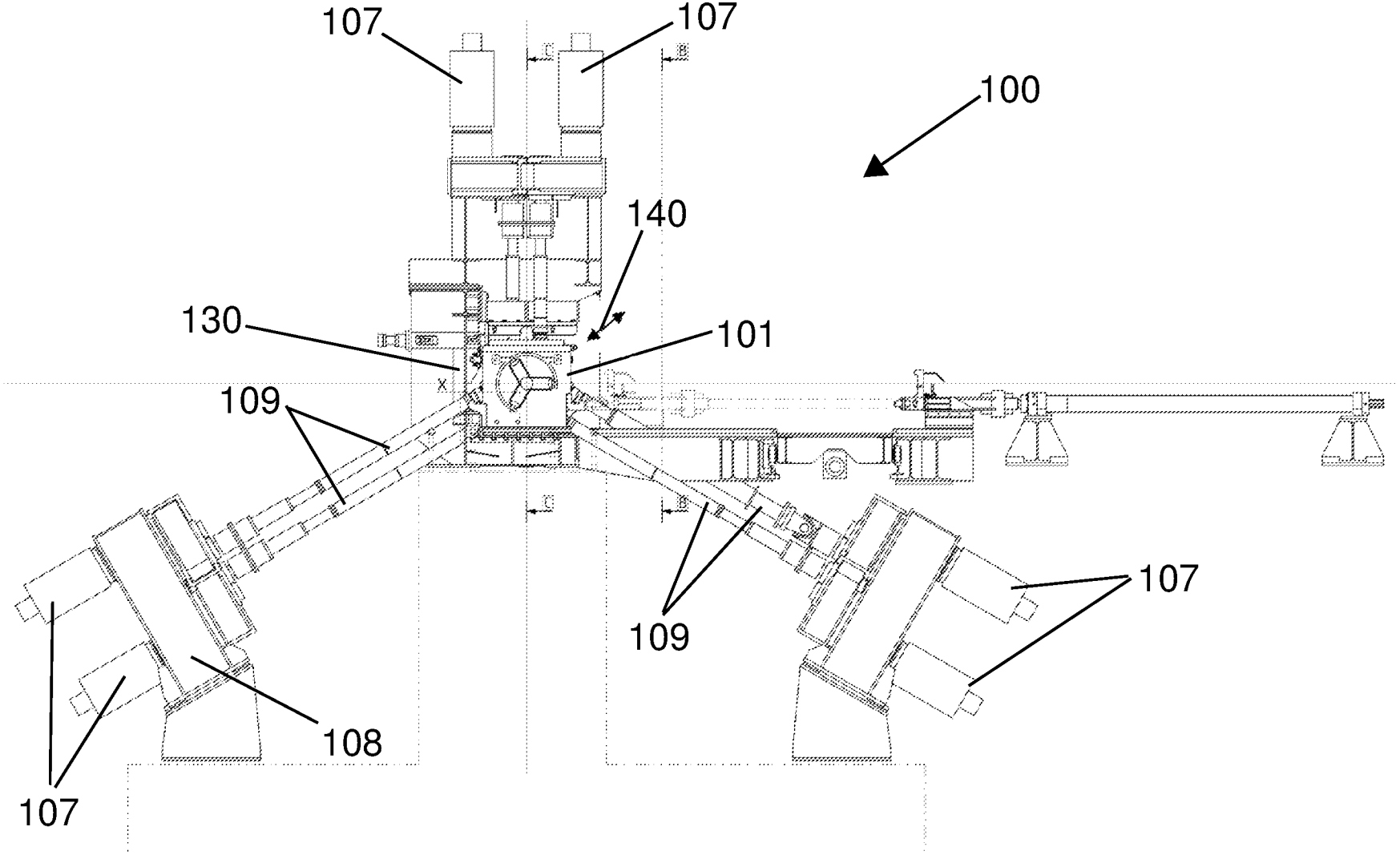
FIG. 3 shows a front view of a rolling mill according to an embodiment with at least one stand in the operating position.
Figure 4:
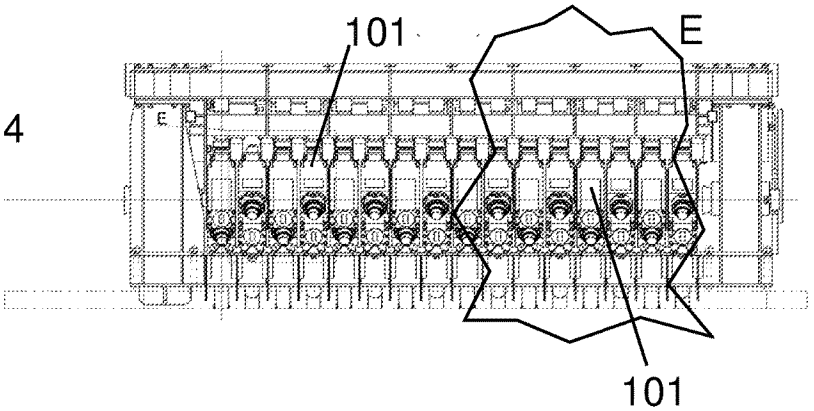
FIG. 4 shows a side view of a rolling mill according to an embodiment according to the plane B-B in FIG. 3.
Figure 5:
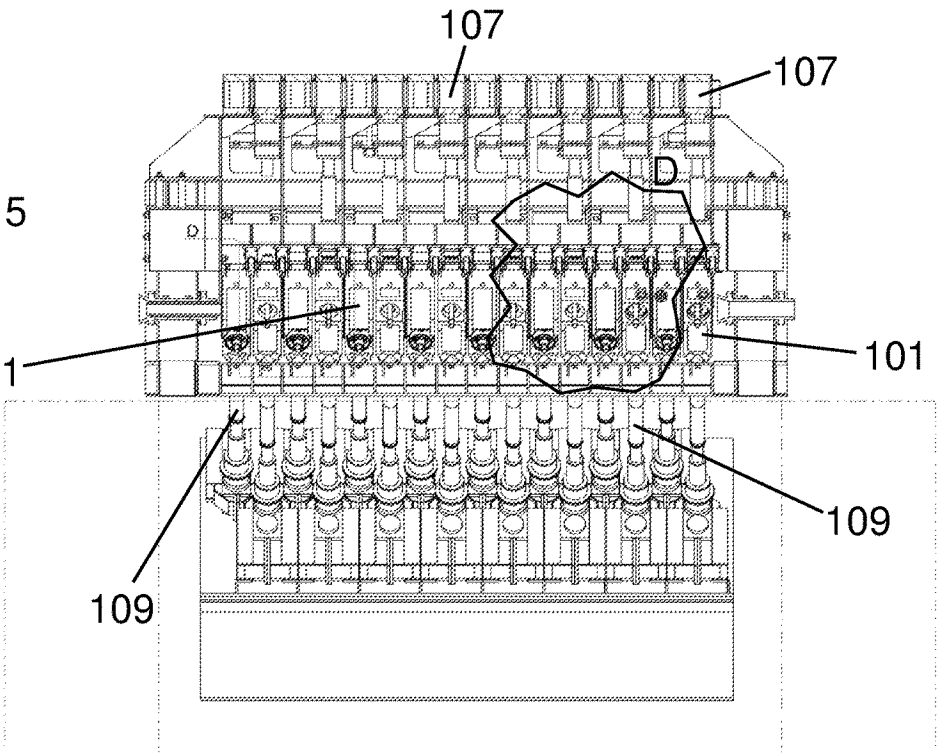
FIG. 5 shows a sectional view of a rolling mill according to an embodiment according to the plane C-C in FIG. 3.
Figure 7:
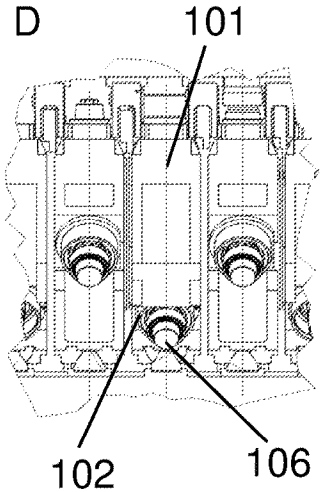
FIG. 7 shows an enlargement of the detail D indicated in FIG. 5.

In FIGS. 1 to 3, reference numeral 100 identifies a rolling mill according to an embodiment as a whole.

As shown, the rolling mill 100 comprises a plurality of rolling stands 101 each adapted to be repositioned (switched) by translation between a first operating position (FIG. 3) and a second resting position (FIGS. 1 and 2); the methods for translating the stands 101 between said operating and resting positions do not necessarily fall within the scope of the present invention so that, since said translation methods are at least partially substantially known (see the following description), a detailed description thereof is omitted for synthesis reasons.

Each of the stands 101 further comprises a plurality of rollers 102 (FIG. 9), each roller 102 being provided with an end portion 103 which is integral with a rotation shaft 106 adapted to be rotated, the end portion 103 being shaped so as to define a peripheral groove 104, wherein, in each stand 101, the portions 103 are positioned to define a central passage 105 with a cross-section which is substantially circular or with a combination of circular sectors or differently shaped according to the features of the product and the process to be carried out.

With the stands 101 in the operating position in FIG. 3, the stands 101 are aligned along a rolling direction (from left to right in FIG. 1) substantially perpendicular to the direction of translation between the operating and the resting positions, wherein therefore the respective passages 105 are mutually aligned to define a rolling passage along which the products being rolled are first inserted into the first end stand 101 (on the left in FIG. 1), translated between the intermediate stands 101 and finally expelled through the last end stand 101 (on the right in FIG. 1).

In each stand 101 each respective rotation shaft 106 of each respective roller 102 is adapted to be rotated about a rotation axis R-R thereof, wherein the methods for rotating the shafts 106 and/or the portions 103, according to the present invention, may vary both according to the applications as well as to the specific needs and/or circumstances. Said methods may in fact comprise both gears internal to each stand 101 as well as individual external drives of the type shown in the FIGS. 1 to 3, as well as solutions with external gears which connect the three drive shafts of the rollers of a stand with a single shaft in turn connected to a motor.

Said individual drive comprises, for each roller 102 of each stand 101, a reducer motor system comprising a motor 107, a reducer 108 and a transmission shaft 109 connected to the rotation shaft 106 of said roller 102.

Even the methods for rotating the shaft 106 and/or the portion 103 of each roller 102 do not necessarily fall within the scope of the present invention, therefore a detailed description thereof is omitted for synthesis reasons.

Figure 9:
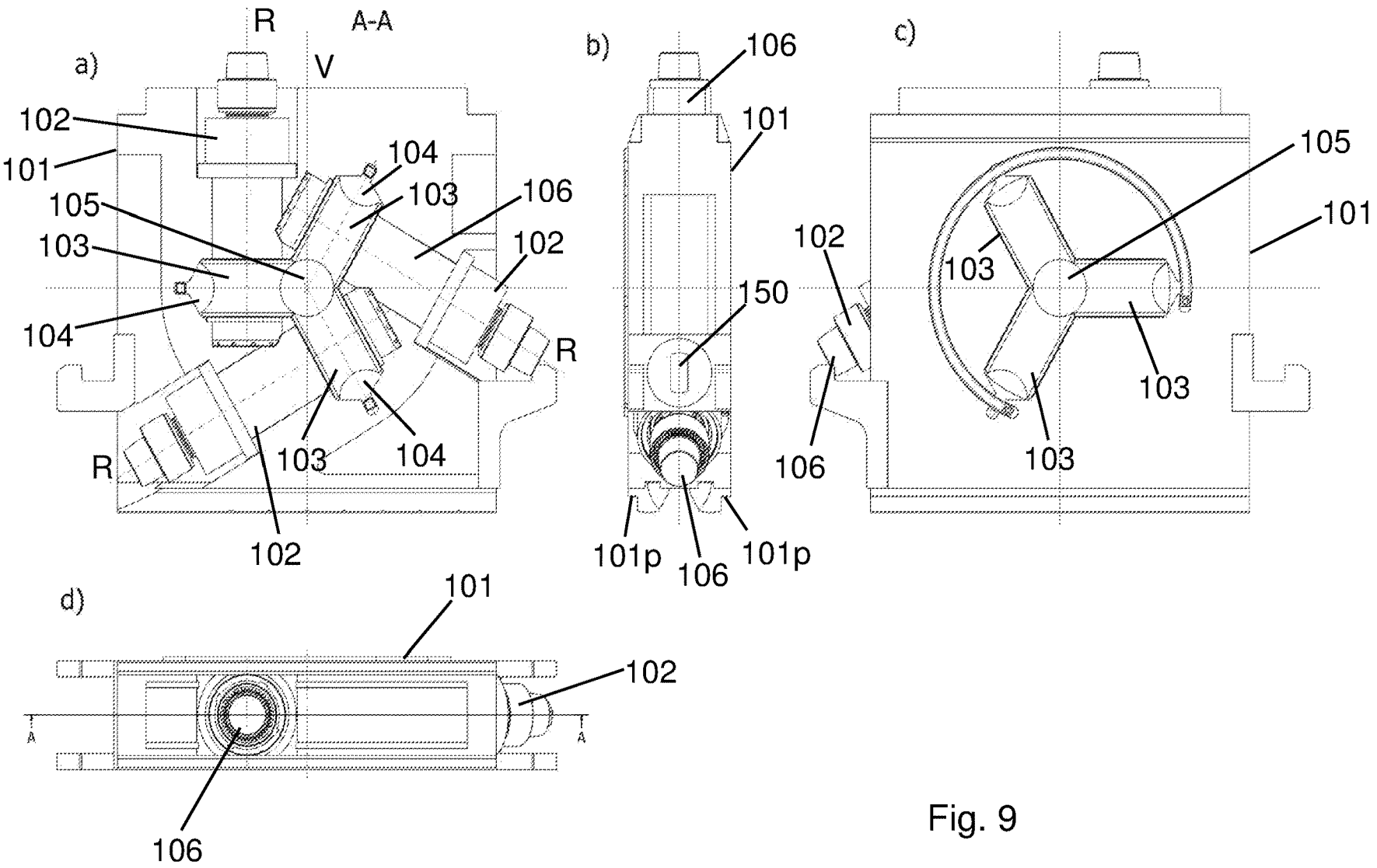
FIG. 9 show a side sectional view, a side view, a rear view and a top view, respectively, of a rolling stand according to an embodiment.

One of the innovative characteristics of the present invention is shown in FIG. 9 from which it is apparent that in the stands 101 (in particular, in at least two of said stands 101) at least one of the rollers 102 has a rotation axis R-R arranged substantially vertically, wherein the remaining two rollers 102 have rotation axes R-R arranged so as to form angles of 210° and 330°, respectively, with respect to a horizontal reference perpendicular to the vertical axis V-V passing through the center of said passage 105, and wherein the vertical axis V-V does not coincide with the rotation axis R-R of the roller 102 with a vertical rotation axis or shaft 106.

The mutual arrangement of the rollers 102, in particular of the respective rotation shafts 106, and in particular the fact that at least one roller 102 has a vertical rotation shaft 106, allows that at least two stands 101 may be arranged in sequence and adjacent to each other along the rolling path so that the position of the rolling rollers 102 of a first rolling stand 101 corresponds to the position of the rollers 102 of the second rolling stand 101 resulting from the 180° rotation of said second rolling stand 101 about the vertical axis V-V passing through the center of the respective passage 105 (see in particular FIGS. 10*a* and 10*c*).

Further characteristics of the present invention are described below with reference to FIGS. 1 to 6.

Figure 6:
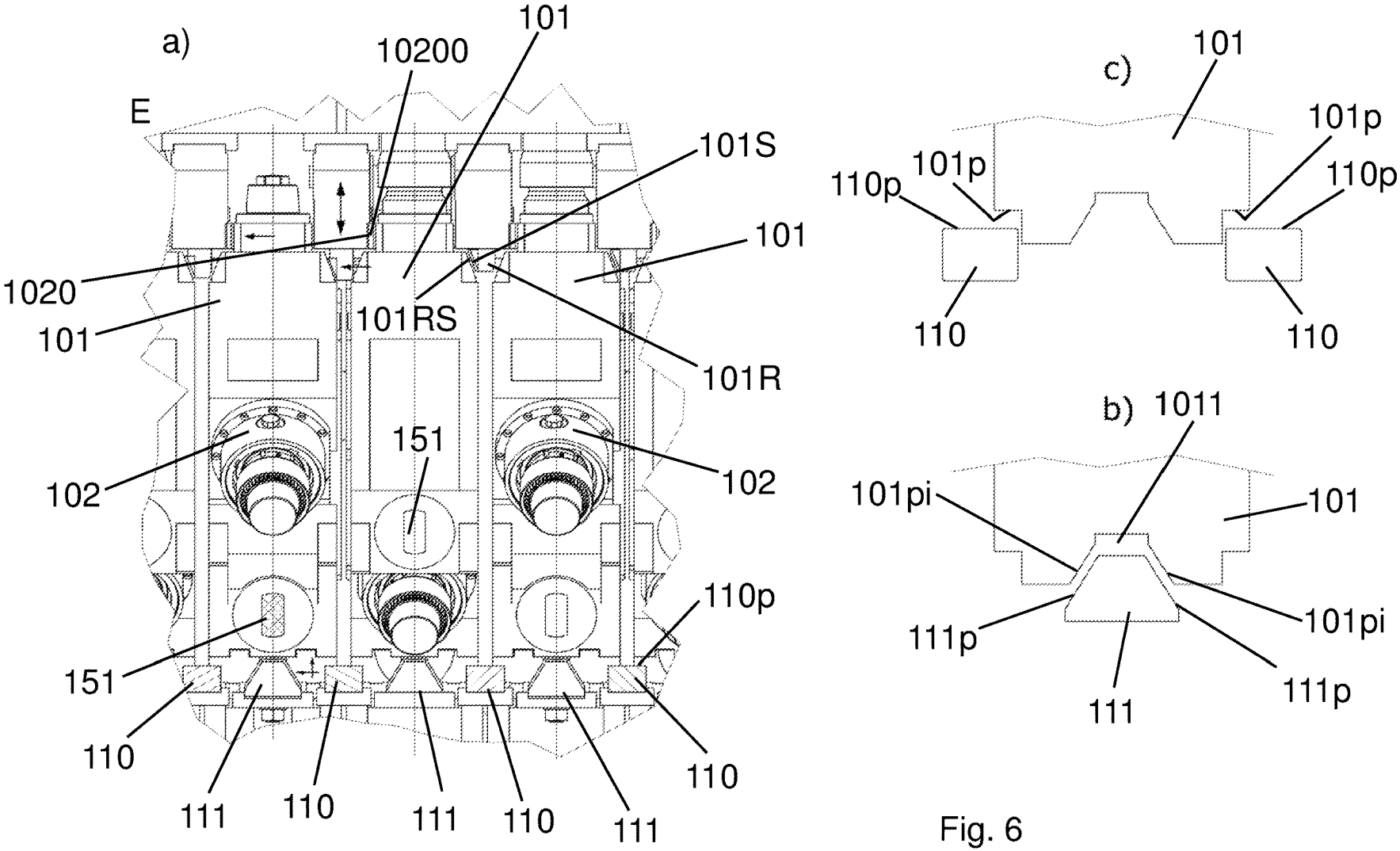
FIG. 6 show an enlargement of the detail E indicated in FIG. 4 and side views of details according to an embodiment of the present invention, respectively.

In fact, it may be seen from FIGS. 1 and 6 that the repositioning of the stands 101 from the resting position to the operating position and vice versa occurs by translating the stands partly on translation guides 110 and partly on positioning guides 111; in particular, each rolling stand 101 is moved towards the operating position thereof by sliding on two parallel translation guides 110 arranged adjacent to each other and each having a substantially rectangular cross section. In detail, when moving towards said operating position each stand 101 rests on said two adjacent translation guides 110, wherein the stand 101 is in contact with said two adjacent guides 110 at the portions 101*p* (FIG. 6*c*) of the lower surface thereof and at the portions 110*p* of the upper surfaces of the guides 110, respectively.

During the path towards the operating position, the stand 101 loses contact with the translation guides 110 to come into contact with the positioning guide 111 whose longitudinal extension substantially corresponds to the transverse extension of the stand 101, wherein in the last section of the repositioning path (from the resting position to the operating position) the stand 101 is guided and supported exclusively by the positioning guide 111. Said positioning guide has a substantially trapezoidal cross-section, wherein each guide 111 comprises an upper surface and a lower surface mutually parallel and joined by two inclined and opposite surfaces 111*p*, and wherein the lower surface of the stand 101 is shaped so as to define an accommodation seat 1011 adapted to accommodate said positioning guide 111 at least partially. In this step of repositioning the guide 101 and also with the guide 101 in the operating position, the stand 101 rests on the positioning guide 111 and is in contact with said guide 111 at inclined portions 101*pi* (FIG. 6) of the lower surface thereof and at corresponding portions of the inclined surfaces 111*p* of the guide 111, respectively.

It is therefore apparent that, when the stand 101 loses contact with the guides 110 and comes into contact with the guide 111, the further translation of the stand 101 on the guide 111 and towards the final operating position results in the vertical positioning of the stand 101 by mutual contrast between the surfaces 111*p* of the guide 111 and the surfaces 101*pi* of the stand 101.

The mutual contrast between the surfaces 111*p* of the guide 111 and the surfaces 101*pi* of the stand 101 also contributes to the positioning of at least the lower part of the stand 101 along the rolling direction (transversely with respect to FIG. 6), transversal with respect to the translation repositioning direction.

However, according to the embodiment in FIGS. 6, the improvement of the position of the stand 101, in particular of the upper position of the stand 101 opposite to the guide 111, along the rolling direction and so as to compensate for positioning tolerances which may be due, for example, to imperfections of the contrast surfaces 101*pi* and/or 111*p*, are obtained through additional means which are suitable for the purpose.

Said additional means comprise a plurality of vertically movable (translatable) abutments 101R (see the double arrows in FIG. 6*a*), wherein the end portion of each of said movable abutments 101R comprises a thrust surface 101RS which is inclined with respect to the translation direction thereof (substantially vertical), and wherein the vertical translation from the top downwards of each of the movable abutments 101R results in the engagement by said inclined surface 101RS against a respective inclined surface 101S of a respective stand 101, and therefore in a thrust in a direction parallel to the rolling direction on the upper part of said respective stand 101 (see the horizontal arrow in FIG. 6), wherein said horizontal thrust results in the engagement of an abutment surface 1020 of the stand 101 against an opposite surface 10200 of a fixed abutment of the frame, and therefore, ultimately, in the positioning along the rolling direction of at least the upper part of said stand 101.

Further characteristics or features of the rolling mill 100 according to the present invention are described below with reference to FIG. 3.

Said further characteristics or features comprise a fixed abutment 130 with longitudinal extension parallel to the rolling direction (and therefore transversal with respect to the plane in FIG. 8) against which each stand 101 abuts when positioned in the operating position, wherein, therefore, the fixed abutment 130 defines the end-of-stroke position of each stand 101 during the translation from the resting position to the operating position. Also in this case, in order to compensate for any positioning tolerances or inaccuracies due to imperfections of the abutment 130 and/or of the corresponding abutment surface of each stand 101, means 140 are provided, such as a hydraulic or pneumatic piston (only diagrammatically shown in FIG. 3 by means of the double arrow), adapted to be extended and retracted alternately, wherein the extension of the piston 140 (in an oblique direction with respect to the translation direction of the guides 101), results in a thrust on the stand 101 towards the end-of-stroke position and/or the operating position, and therefore in the precise and reliable positioning of at least the upper part of the stand 101 transversely to the rolling direction.

Figure 8:
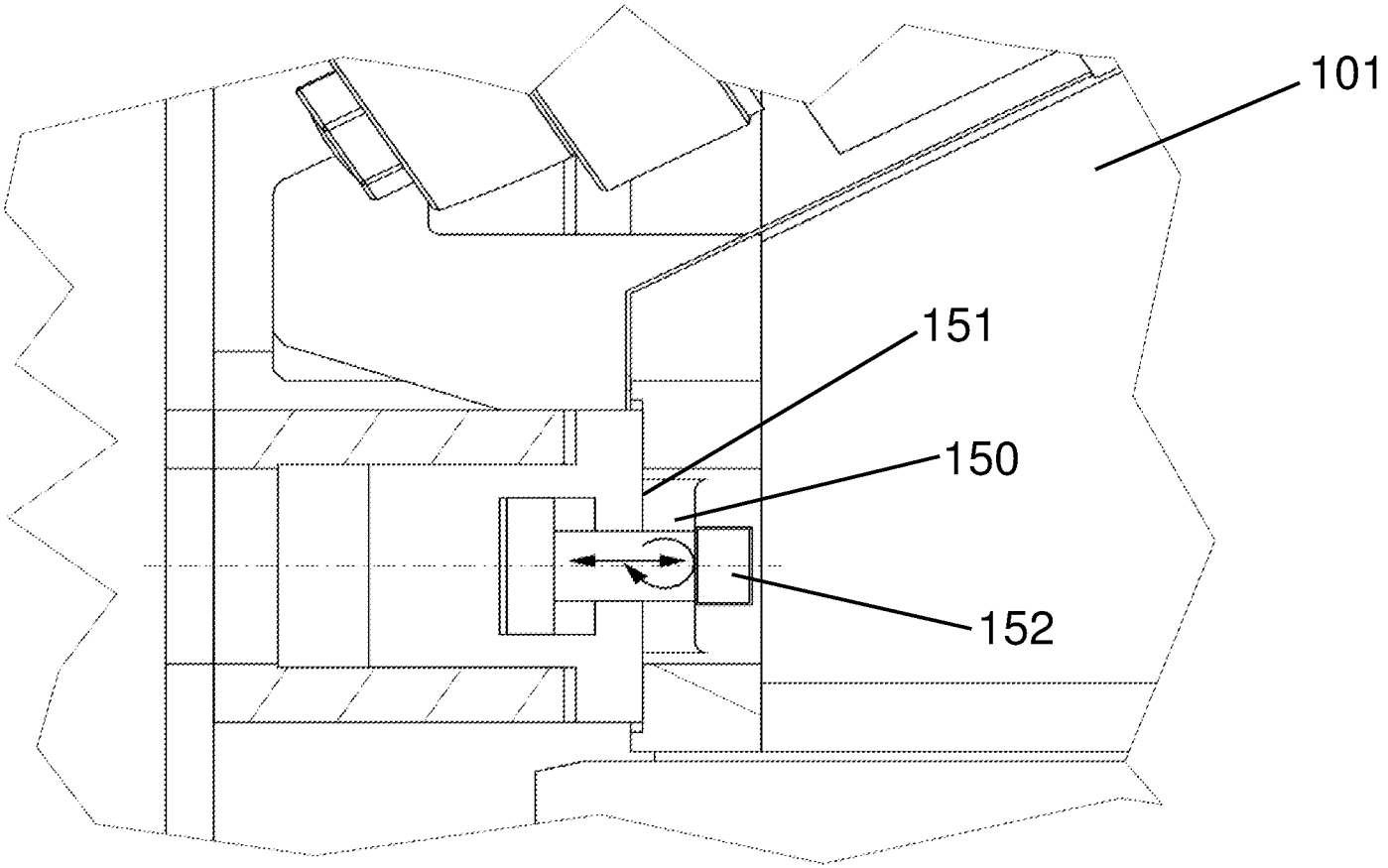
FIG. 8 shows a front view of a portion of a rolling stand according to an embodiment.

Alternatively or in addition to the solution just described with reference to FIG. 3, and again in order to improve the positioning of the stands 101 transversely to the rolling direction, according to the embodiment in FIG. 8, at least one stand 101 comprises a hollow engagement seat 150 extending towards the inside of the stand 101 from the surface of the stand 101 intended to abut against the fixed abutment 130 and communicating with the outside from the stand 101 by means of an oblong opening 151. On the other hand, for said at least one stand 101, the rolling mill 100 comprises a jack 152 adapted to be translated along a direction parallel to the positioning direction of the stand (from the resting position to the operating position and vice versa) in two opposite translation directions (see the double arrow in FIG. 8), wherein the jack 152 is also adapted to be rotated with respect to a rotation axis parallel to the translation direction thereof. Furthermore, the jack 152 comprises a head or free end portion shaped so as to be introduced into and extracted from the hollow seat 150 through the opening 151 only at one or more radial positions, wherein, in contrast, with the jack 152 rotated and positioned radially in at least one different position, said head or end portion may neither be inserted into nor extracted from the hollow seat 150 through the opening 151. The positioning of the stand by means of the jack 152 thus provides for said jack 152 to be translated (extended) towards the stand 101 and rotated so that the head of the jack 152 may pass through the opening 151 of the seat 150, wherein therefore the movement of the stand 101 towards the fixed abutment 130 results in the insertion of the head of the jack 152 into the hollow seat 150.

The jack 152 is therefore rotated so that the head thereof may not come out of the seat 150 and is retracted in the translation direction of the stand 101 towards the operating position and/or the end-of-stroke position. The retraction of the jack 152 therefore results in a traction on the stand 101 until this is brought to the end-of-stroke position and/or operating position thereof, for example, if said end-of-stroke position has not been reached by translation of the stand and/or through the positioning means described above.

In view of what has been described above, the methods for arranging a rolling mill 100 according to the embodiments of the present invention for implementing or carrying out a rolling cycle or process may be summarized as follows.

With the stands 101 in the resting position (FIGS. 1 and 2), those between the N rolling stands 101 which are necessary for the implementation of the rolling cycle are translated from the resting position to the operating position. In this regard, it should be noted that in the resting position the stands 101 may be arranged in pairs or sets comprising stands 101 in an even position and stands in an odd position (rotated by 180° with respect to the even stand about a vertical axis passing through the passage 105, see previous description). It is also specified that the stands 101 may be translated to the operating position both individually as well as simultaneously (in groups of variable numbers according to the needs and/or circumstances).

As anticipated, the translation of the stands 101 towards the operating position occurs first on the translation guides 110 and subsequently on the positioning guides 111, wherein during the first step the pushers or pistons 140 (if present) are switched to the rear or retracted position so as not to interfere with the translation of the respective stands 101, and wherein the jacks 152 (if present) are switched to the extended position and rotated so as to allow the insertion of the respective heads or end portions into the respective seats 150 of the respective stands 101 (and therefore so that not even the jacks 152 interfere with the translation of the respective stands 101).

Again as anticipated, the improvement of the positioning of the stands in the respective final operating or end-of-stroke positions is obtained by activating, where necessary, one or more of the movable abutments 101R (for the positioning in a direction parallel to the rolling direction) and/or the pushers 140 and/or the jacks 152 (for the positioning in the direction transversal to the rolling direction and in the translation direction of the stands 101 towards the operating or end-of-stroke positions thereof.

Finally, it is useful to specify that in the rolling mill 100 according to an embodiment of the present invention, the translation guides 110 are not superimposed or are only partially superimposed to the positioning guides 111 according to a front or rear view of the rolling mill 100 (according to a view parallel to the rolling direction). In practice, therefore, the translation guides 110 do not extend or only partially extend in the part of the rolling mill in which the stands 101 are positioned in the operating position. This means that, between two adjacent stands 101 in the operating position, the space is not obstructed (or is only partially obstructed) in the vertical direction by the translation guides 110, wherein therefore the downwards fall of the cooling water and/or of any process residues (scale or the like) between the stands 101 is free and not hindered by the translation guides 110 and not even by the positioning guides 111, wherein, in contrast, the positioning guides 111, each arranged under a respective stand 101, are protected by the stands 101 themselves.

Therefore, it has been demonstrated, by means of the previous detailed description of the embodiments of the present invention depicted in the drawings, that the present invention allows achieving the desired results and overcoming or at least limiting the drawbacks affecting solutions according to the prior art.

In particular, a rolling mill is provided according to the present invention, which allows:

- Ensuring the vertical alignment and abutment of each stand, independent of whether the stand is used in an even or an odd position and therefore so that, even if roller regeneration systems with stand turning are used, it never needs to be overturned between the preparation condition and the working condition;
- eliminating or at least reducing the effects of gravity;
- ensuring greater safety and practicality/speed in the management/preparation of the equipment with respect to machines which need to rotate the stands 1800 about the horizontal axis;
- offering the possibility of implementing an individual locking and alignment system for each stand in the 3 directions;
- permitting a positioning of the motors (in the case of a configuration with individual drive for each roller), reducers and transmission systems which is advantageous with respect to existing machines since it is more distant from the vertical passing through the rolling axis and therefore far from water and scale which are typically the cause of damage and high maintenance costs;
- permitting the individual locking of the stands, thus avoiding issues relating to the vibration/oscillation/impact of the stands with respect to the frame of the machine, triggered by the "alternative" feature of the process, for which at each rolling cycle there is a loading transient, an unloading transient, a continuous loading stage, a waiting stage, and, where it is possible, within the cycle itself, having rolling loads, in particular torques necessary for the rollers, which change direction from positive to negative and vice versa;
- reducing the noise of the machine, limiting the wear thereof and the deterioration of the alignment surfaces of the stands, thus reducing maintenance costs, and improving the reliability of the machine and production process;
- ensuring a correct and constant alignment of the rolling stands in all directions, with a consequent advantage on the quality of the product and on safety, taking into consideration the limitation of the risks of missed feed and/or leakage of the product and/or sticking;
- reducing product changing times, allowing to individually replace the stands and consequently also to move the minimum possible number of stands;
- reducing operating costs, limiting the number of guide stands with a consequent reduction in weight and/or complexity of the equipment;
- avoiding cumulative displacements between the stands, linked to processing tolerances and/or wear in the application of the locking in the axial direction (along the rolling axis).

Furthermore, according to the present invention, a rolling mill is provided adapted to reduce the wear of the alignment guides by utilizing, for the vertical and longitudinal alignment from the lower side of the stand, the central part thereof, which is therefore protected from water and scale during the rolling, and by leaving the space between two adjacent stands completely open below for the outflow of water and scale.

Finally, according to the present invention a rolling mill is provided which ensures the correct alignment of the stands and the locking thereof in the alignment position.

Although the present invention is explained above by means of the detailed description of the embodiments depicted in the drawings, the present invention is not limited to the embodiments described and depicted in the drawings; on the contrary, all those variants and/or changes of the embodiments described and depicted in the accompanying drawings are within the scope of the present invention and will appear obvious and immediate to those skilled in the art.

For example, the present invention offers the possibility of varying, according to the needs and/or circumstances, the total number of rolling stands 101, the number of rollers 102 in at least part of the stands 101, the methods for rotating the rollers 102, as well as the methods for switching the stands 101 at least along the translation guides 110.

The scope of protection of the present invention is thus defined by the claims.

The invention claimed is:

1. A calibrating roll mill for rod-shaped bodies comprising a plurality of rolling stands, wherein each of said plurality of rolling stands comprises a plurality of rolling rollers mutually arranged so as to define a respective passage for said rod-shaped bodies, wherein said plurality of rolling stands are arranged in sequence along a rolling direction so that said respective passages are aligned to define a rolling path parallel to said rolling direction, wherein at least two rolling stands of said plurality of rolling stands each comprise said plurality of rolling rollers consisting of three rolling rollers, wherein each rolling stand of said at least two rolling stands is individually constrained within said calibrating rolling mill;

wherein each rolling stand of said at least two rolling stands is translationally positionable between a first position, in which said respective passages are substantially aligned to define said rolling path, and a second position; and wherein, in said first position, each rolling stand of said at least two rolling stands rests on a respective positioning guide shaped so that a translation from said second position to said first position on said respective positioning guide results in an at least vertical positioning of said rolling stand; and wherein for each rolling stand of said at least two rolling stands, said calibrating rolling mill comprises at least one fixed transversal positioning abutment for positioning said rolling stand transversely to said rolling direction and parallel to a translation direction of said rolling stand from said second position to said first position.

2. The calibrating rolling mill for rod-shaped bodies according to claim 1, wherein in each rolling stand of said at least two rolling stands a rotation axis of at least one rolling roller of said three rolling rollers is vertically oriented.

3. The calibrating rolling mill for rod-shaped bodies according to claim 2, wherein in each rolling stand of said at least two rolling stands, said vertically oriented rotation axis of said at least one rolling roller does not coincide with a vertical axis passing through a center of said respective passage.

4. The calibrating rolling mill for rod-shaped bodies according to claim 3, wherein in each rolling stand of said at least two rolling stands, said three rolling rollers, other than said at least one rolling roller with said vertically oriented rotation axis, have rotation axes arranged to form 210° and 330° angles, respectively, with respect to a horizontal reference perpendicular to said vertical axis passing through said center of said respective passage.

5. The calibrating rolling mill for rod-shaped bodies according to claim 1, wherein said at least two rolling stands are arranged adjacent to each other along said rolling direction, and wherein a position of said three rolling rollers of a first rolling stand of said at least two rolling stands corresponds to the position of the three rolling rollers of a second rolling stand of said at least two rolling stands resulting from a 180° rotation of said second rolling stand about a vertical rotation axis passing through a center of said respective passage.

6. The calibrating rolling mill for rod-shaped bodies according to claim 1, wherein said respective positioning guide of each rolling stand of said at least two rolling stands is shaped so that said translation of said rolling stand on said respective positioning guide results in a positioning even along a direction parallel to said rolling direction of said calibrating rolling mill.

7. The calibrating rolling mill for rod-shaped bodies according to claim 1, wherein said respective positioning guide of each rolling stand of said at least two rolling stands extends parallel to said translation direction of said rolling stand from said second position to said first position, and wherein a cross-section of each of said respective positioning guides is trapezoidal.

8. The calibrating rolling mill for rod-shaped bodies according to claim 7, wherein for each rolling stand of said at least two rolling stands, portions of said respective positioning guide in contact with said rolling stand are opposite to portions of said rolling stand.

9. The calibrating rolling mill for rod-shaped bodies according to claim 1, wherein for each rolling stand of said at least two rolling stands, said calibrating rolling mill comprises at least one translation guide, wherein said translation of each rolling stand of said at least two rolling stands from said second position to said first position partly occurs on said respective positioning guide and partly on said at least one translation guide, and wherein each of said translation guides has a transversal shape which is different from that of the respective positioning guide.

10. The calibrating rolling mill for rod-shaped bodies according to claim 1, wherein for each rolling stand of said at least two rolling stands, said translation from said second position to said first position results in a mutual engagement of said at least one fixed transversal positioning abutment and said rolling stand.

11. The calibrating rolling mill for rod-shaped bodies according to claim 1, wherein for each rolling stand of said at least two rolling stands, said calibrating rolling mill comprises first repositioning means adapted to act upon thrust against said rolling stand in said translation direction of said rolling stand from said second position to said first position.

12. The calibrating rolling mill for rod-shaped bodies according to claim 11, wherein for each rolling stand of said at least two rolling stands, said calibrating rolling mill comprises second repositioning means adapted to act upon traction on said rolling stand in said translation direction of said rolling stand from said second position to said first position.

13. The calibrating rolling mill for rod-shaped bodies according to claim 12, wherein said second positioning means comprise a piston or jack which is translatable in two opposite translation directions along a direction parallel to said translation direction of said rolling stand from said second position to said first position, and wherein said rolling stand comprises a seat adapted to be engaged by said piston or jack.

14. A stretch reducer rolling mill for rod-shaped bodies comprising a plurality of rolling stands, wherein each of said plurality of rolling stands comprises a plurality of rolling rollers mutually arranged so as to define a respective passage for said rod-shaped bodies, wherein said plurality of rolling stands are arranged in sequence along a rolling direction so that said respective passages are aligned to define a rolling path parallel to said rolling direction, wherein at least two rolling stands of said plurality of rolling stands each comprise three rolling rollers, wherein each rolling stand of said at least two rolling stands is individually constrained within said stretch reducer rolling mill;

wherein each rolling stand of said at least two rolling stands is translationally positionable between a first position, in which said respective passages are substantially aligned to define said rolling path, and a second position;

wherein, in said first position, each rolling stand of said at least two rolling stands rests on a respective positioning guide shaped so that a translation from said second position to said first position on said respective positioning guide results in an at least vertical positioning of said rolling stand; and wherein for each rolling stand of said at least two rolling stands, said stretch reducer rolling mill comprises at least one fixed transversal positioning abutment for positioning said rolling stand transversely to said rolling direction and parallel to a translation direction of said rolling stand from said second position to said first position.

* * * * *